US011832674B2

(12) United States Patent
Cronk

(10) Patent No.: US 11,832,674 B2
(45) Date of Patent: Dec. 5, 2023

(54) SOFT MOBILE PHONE POUCH HAVING ACOUSTIC PROPERTIES

(71) Applicants: Brian Cronk, Moorestown, NJ (US); Connor Cronk, Moorestown, NJ (US)

(72) Inventor: Peter J. Cronk, Moorestown, NJ (US)

(73) Assignees: Brian Cronk, Moorestown, NJ (US); Connor Cronk, Moorestown, NJ (US)

( * ) Notice: Subject to any disclaimer, the term of this patent is extended or adjusted under 35 U.S.C. 154(b) by 183 days.

(21) Appl. No.: 17/394,731

(22) Filed: Aug. 5, 2021

(65) Prior Publication Data

US 2021/0378341 A1 Dec. 9, 2021

Related U.S. Application Data

(63) Continuation-in-part of application No. 16/663,540, filed on Oct. 25, 2019, now Pat. No. 11,520,942.

(51) Int. Cl.
*A42B 1/245* (2021.01)
*A42B 1/241* (2021.01)

(52) U.S. Cl.
CPC ..... *A42B 1/245* (2013.01); *A42B 1/241* (2013.01)

(58) Field of Classification Search
CPC ..... A42B 1/245; A42B 1/241; H04R 5/033; H04R 5/0335
See application file for complete search history.

(56) References Cited

U.S. PATENT DOCUMENTS

| | | | | |
|---|---|---|---|---|
| 6,068,401 | A * | 5/2000 | Ho | A45C 3/001 150/900 |
| 7,974,432 | B1 * | 7/2011 | Ryan | H04R 5/033 381/376 |
| 9,071,903 | B1 * | 6/2015 | Crockran, Jr. | H04R 1/1058 |
| 9,578,409 | B1 * | 2/2017 | Crockran, Jr. | A42B 1/241 |
| 9,819,788 | B2 | 11/2017 | Dugoni | |
| 11,463,794 | B1 * | 10/2022 | Guo | H04R 1/1025 |
| 2004/0128737 | A1 * | 7/2004 | Gesten | A42B 1/245 2/171 |
| 2007/0226876 | A1 * | 10/2007 | Foust | A42B 1/245 2/171 |
| 2008/0144872 | A1 * | 6/2008 | Phillips | H04R 5/0335 381/301 |

(Continued)

OTHER PUBLICATIONS

Abramovitch, Seth, "How Dave Chappelle Is Creating a "No Phone Zone" for His Chicago Shows," Hollywood Reporter, https://www.hollywoodreporter.com/news/how-dave-chappelle-is-creating-844886, Dec. 1, 2015, pp. 1-4.

(Continued)

*Primary Examiner* — Yuwen Pan
*Assistant Examiner* — Angelica M Perez
(74) *Attorney, Agent, or Firm* — DUANE MORRIS LLP

(57) ABSTRACT

A soft mobile phone pouch is provided, which comprises an elastic fabric, forming a soft-walled pocket having a longitudinal length, a width and a depth, an opening for receiving a mobile phone, so that said mobile phone is substantially disposed within said pocket, and one or a plurality of fasteners for removably attaching said pouch to an article of clothing, whereby the internal speakers of said mobile phone are positioned to direct audio sound to the ears of the wearer. The pouch can include RF/EMF protective materials and can be made waterproof.

13 Claims, 6 Drawing Sheets

(56) References Cited

U.S. PATENT DOCUMENTS

| | | | | |
|---|---|---|---|---|
| 2009/0175482 | A1* | 7/2009 | Crutcher | H04R 1/1033 381/376 |
| 2011/0000941 | A1* | 1/2011 | Volk | A45C 11/18 224/181 |
| 2013/0248064 | A1* | 9/2013 | Dockman | A45F 5/02 150/134 |
| 2014/0185852 | A1* | 7/2014 | Pereira | H04R 5/04 381/333 |
| 2014/0355807 | A1* | 12/2014 | McDowell | H04R 5/0335 381/334 |
| 2015/0289048 | A1* | 10/2015 | Schermerhorn | A63B 33/004 381/376 |
| 2017/0208924 | A1* | 7/2017 | Wu | A45C 13/008 |
| 2017/0245571 | A1* | 8/2017 | Csillag | A42B 1/004 |
| 2019/0082321 | A1 | 3/2019 | Dugoni | |
| 2019/0104831 | A1* | 4/2019 | Lazzara | H04B 1/3888 |

OTHER PUBLICATIONS

Burch, Cathalena E., "Ali Wong's Tucson Show to Require that Cell Phones be Locked in Pouches," Arizona Daily Star, https://tucson.com/news/local/ali-wong-s-tucson-show-to-require-that-cell-phones/article_6fc4419b-144c-5a34-adc2-6c241e4a2a26.html, Feb. 16, 2019, pp. 1-4.

Wenzel, John, "How Dave Chappelle Introduced a Cellphone-Bagging Program to Denver Schools," The Denver Post, https://www.denverpost.com/2017/08/24/yondr-dave-chappelle-cellphone-bagging-denver-schools/, Aug. 24, 2017, pp. 1-4.

https://www.securitytags.com/the-different-types-of-security-tags/, printed Oct. 15, 2019, pp. 1-6.

ZSDTRP Universal Motorcycle Clocks Watch Waterproof Stick on Motorbike Mount Watch Moto Digital Clock-in Instruments from Automobiles, www.aliexpress.com/item/32899951427.html, printed Oct. 15, 2019, pp. 1-14.

Integrated Biometrics, "LES Film Technology, Fingerprint Sensor Descriptions and Alternative Fingerprint Technologies," https://integratedbiometrics.com/wp-content/uploads/2016/08/LES_White_Paper.pdf, Integrated Biometrics, Spartanburg, SC, pp. 1-16, date of reference Aug. 2016.

Grabham, Dan, "In-Display Fingerprint Readers: How Do They Work and What Phones Will We See Them In?," https://www.pocket-lint.com/phones/news/huawei/146063-in-display-fingerprint-readers-how-do-they-work, Feb. 28, 2019, pp. 1-5.

The Whiz Cells, "The 5 Largest Cell Phone Screens on the Market Today," https://www.thewhizcells.com/the-5-largest-cell-phone-screens-on-the-market-today/, Feb. 22, 2019, pp. 1-3.

Tung, Liam, "Galaxy S10 Ships With Screen Protector as Others May Block Fingerprint Sensor," https://www.zdnet.com/article/galaxy-s10-ships-with-screen-protector-as-others-may-block-fingerprint-sensor/, Mar. 1, 2019, pp. 1-5.

Kennemer, Quentyn, "Does the Galaxy S10 Fingerprint Sensor work with Screen Protectors?," https://www.androidcentral.com/does-galaxy-s10-fingerprint-sensor-work-screen-protectors, Feb. 20, 2019, pp. 1-7.

Salem, Elie and Wilson, Maya, "One in Three Yondr Bags Broken After First Advisory," https://thewilsonbeacon.com/13026/news/one-in-three-yondr-bags-broken-after-first-advisory/, The Beacon, Nov. 10, 2018, pp. 1-3.

Morrissey, Janet, "Your Phone's on Lockdown. Enjoy the Show.,"The New York Times, https://www.nytimes.com/2016/10/16/technology/your-phones-on-lockdown-enjoy-the-show.html, Oct. 15, 2016, pp. 1-3.

Walden, Eric, "Utah Fans Review Jack White's Cellphone-Free Show: 'Ridiculous' or 'Friggin' Awesome,' Depending on Whom you Ask," The Salt Lake Tribune, https://www.sltrib.com/artsliving/music/2018/08/10/utah-fans-review-jack/, Aug. 10, 2018, pp. 1-4.

Gregory, Alice , "This Startup Wants to Neutralize Your Phone—And Un-Change the World," Wired, https://www.wired.com/story/free-speech-issue-yondr-smartphones/, Jan. 16, 2018, pp. 1-8.

Hill, Simon, "How to Pick the Best Case to Protect Your Device from Life's Daily Hazards," Digital Trends, https://www.digitaltrends.com/mobile/pick-good-case-cover/, May 9, 2017, pp. 1-12.

Screen Sizes, "Viewport Sizes and Pixel Densities for Popular Devices," http://screensiz.es/phone, printed Oct. 15, 2019, pp. 1-6.

Universal Motorcycle Clock Watch Waterproof Stick-On Motorbike Digital Clock Dia. 1.1, https://www.aliexpress.com/item/32840930147.html, printed Oct. 15, 2019, pp. 1-5.

Handguard II® (White), https://www.wellslamontindustrial.com/product/handguard-ii-white-whizard-wire-gloves/, printed Oct. 15, 2019, pp. 1-4.

Deitzel, J.M. et al., "High performance polyethylene fibers," Elsevier Ltd., http://dx.doi.org/10.1016/8978-0-08-100550-7.00007-3, pp. 1-20, date of reference Jan. 2017 Aug. 19, 2023.

https://www.overyondr.com/, printed Oct. 15, 2019, pp. 1-5.

Nathan Sports, Quick Stash Run Hat, https://www.nathansports.com/products/quick-stash-run-hat, © 2021 Nathan Sports, printed Aug. 4, 2021, pp. 1-4.

Etsy, 90210 Wholesale, Unisex Baseball Cap Plain Pocket Cadet Patrol Military Hats Camo Army Caps Fashion Casual Hat, https://www.etsy.com/listing/687711600/unisex-baseball-cap-plain-pocket-cadet, printed Aug. 4, 2021, pp. 1-13.

Chalktalk Sports, Ultra Pocket Hat for Runners—Black, https://www.goneforarun.com/ultra-pocket-hat-for-runners-black/tr-33136.html?cgid=gfar, printed Aug. 4, 2021, pp. 1-5.

Amazon, Lasmex 17mm Instant Buttons, https://www.amazon.com/Upgrated-Tightener-Adjuster-Replacement-Adjustable/dp/B08THJG8W5, printed Aug. 4, 2021, pp. 1-9.

* cited by examiner

SOFT MOBILE PHONE POUCH HAVING ACOUSTIC PROPERTIES

CROSS-REFERENCE TO RELATED APPLICATIONS

The present application is a continuation-in-part application of U.S. Ser. No. 16/663,540, filed Oct. 25, 2019, which is hereby incorporated by reference it is entirety.

FIELD OF THE INVENTION

The present invention relates to mobile phone pouches and containers for holding said phone for their owners during recreation and exercising activities.

BACKGROUND OF THE INVENTION

Plastic phone cases have been around for almost as long as mobile phones have been commercially available. While protective of the phone, these cases are made for impact resistance and are often wrapped around their phones for the service life of the case. Owners will often secure their phone in its protective case in a pocket or purse when not in use, and will use wired or blue-tooth headphones or earbuds to make calls or listen to music, while the phone is so secured. Wired ear phones present the issue of entanglement with one's clothing, hair style or interference with one's activity, and are becoming scarce with the advent and popularity of wireless Bluetooth earbuds. Many mobile phone today don't even come with a 3.5 mm jack for receiving the pin shaped plug of wired headphones. Earbuds don't present wire entanglement issues, but they must be paired with their mobile phone device and they must be recharged for optimal performance.

There are also devices for securing mobile phones to the arms of runners. Such devices usually have a pocket and a Velcro strap for affixing the phone to the wearer. They are typically paired with earbuds for listening to music. Other devices are designed to allow bikers to attach their phones to the frame or handle bars of their bike. Such devices are generally bulking and require or at least encourage the use of wired or wireless ear phones.

While there have been plenty of innovations in phone securing devices, there still appears to be a need for a simple mobile phone pocket that does not inconvenience the wearer during recreational and exercising activities.

SUMMARY OF THE INVENTION

In a first embodiment of the invention, a soft mobile phone pouch is provided, which comprises an elastic fabric, forming a soft-walled pocket having a longitudinal length, a width and a depth, an opening for receiving a mobile phone, so that said mobile phone is substantially disposed within said pocket, and one or a plurality of fasteners for removably attaching said pouch to an article of clothing, whereby the internal speakers of said mobile phone are positioned to direct audio sound to the ears of the wearer.

In a further embodiment the soft mobile phone pouch is affixed by pin fasteners to the rear of a cap or hat, so that the phone's internal speakers deliver a first sound channel to the right ear and a second sound channel to the left ear of the wearer. Similarly the pouch can be affixed to the front or back of a shirt or jacket, to also direct (on an upward trajectory) a first sound channel to the right ear and a second sound channel to the left ear of the wearer.

In a further embodiment, the soft phone pouch includes an elastic material for gripping a plurality of corners of the phone or phone case. Preferably, the pouch is smaller than the mobile phone and stretched to accommodate the phone, when the phone is inserted therein. In other embodiments, the elastic fabric is stretched to expand substantially around the periphery of the mobile phone and is then snapped in place. In still other embodiments, the pouch is provided with a circular or an oval opening on at least one side for receiving said phone. The opening may be a folded fabric seam and may also comprise elastic fabric. In most preferred embodiments, the elastic fabric is a blend comprising two or more of: cotton, polyester, Spandex (Lycra or elastane) and nylon fibers. In other embodiments the elastic fabric is a stretchy cotton or synthetic fiber blend. Preferably the fabric can stretch at least about 10% and more preferably at least about 50%. In other embodiments, the elastic fabric is substantially sound transparent, or substantially allows sound to pass through with minimum interference. One or more removable fasteners, such as button pins, can be used to affix the pouch to a cap or shirt, for example. An electromagnetic cage material, such as metal threads of copper, aluminum or steel, can also be added to the fabric of the pouch for reducing the transmission of electromagnetic waves from the phone to the user. Preferably this cage material is made to flex and bend to allow the pouch to reversibly stretch to receive the phone. The pouch can also be made waterproof by using closed systems including waterproof or water resistant materials and closure systems.

BRIEF DESCRIPTION OF THE DRAWINGS

The following drawings illustrate preferred embodiments of the invention as well as other information pertinent to the disclosure, whereas.

DETAILED DESCRIPTION OF THE INVENTION

Figure 1:
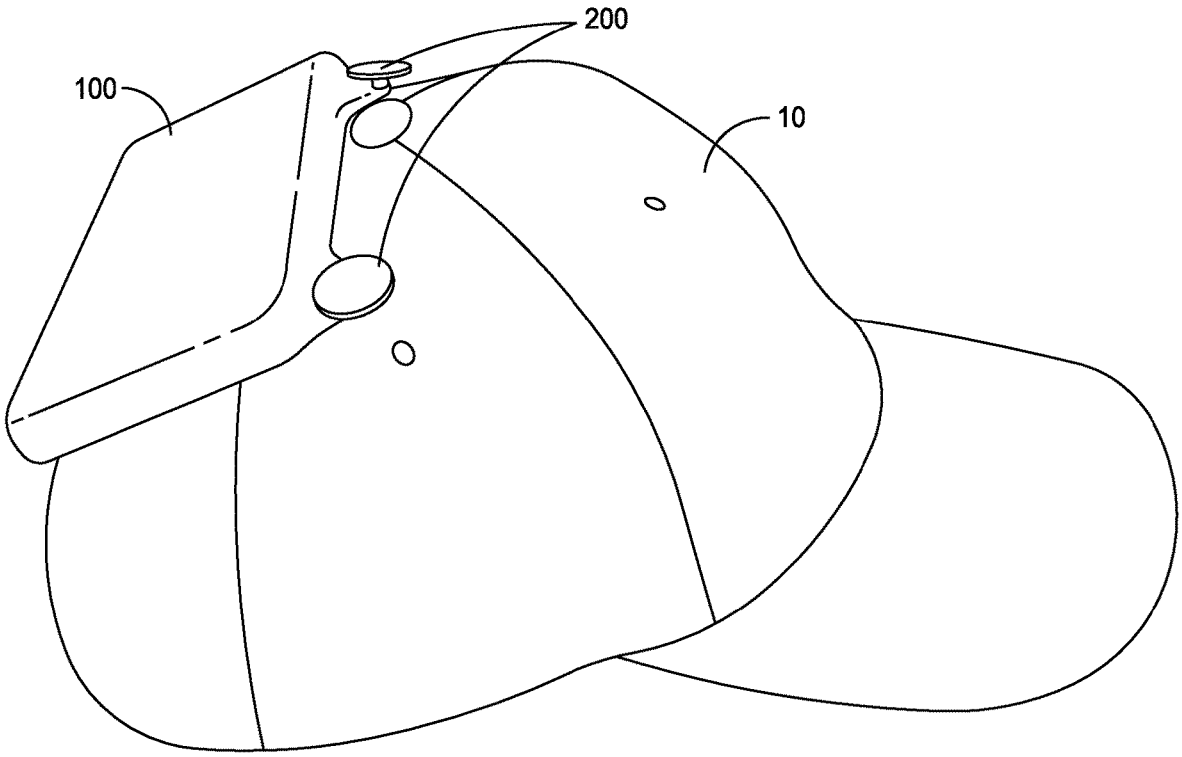
FIG. 1: is a top plan perspective view of the soft mobile phone pouch of this invention holding a mobile phone and secured with a pair of button pins to a baseball cap.

With reference to the Figures, and particularly to FIGS. 1-10, there is shown in a first embodiment, a mobile phone pouch 100 affixed to a cap 10, such as a knit winter cap or baseball cap, by fasteners, such as button pin fasteners 200. The preferred button pin fasteners 200 are two-pieces: a button pin cap 210 and button pin rivet pin 211. Although safety pins, sewn treads, or rivets could also be used, with varying degrees of permanency.

Figure 2:
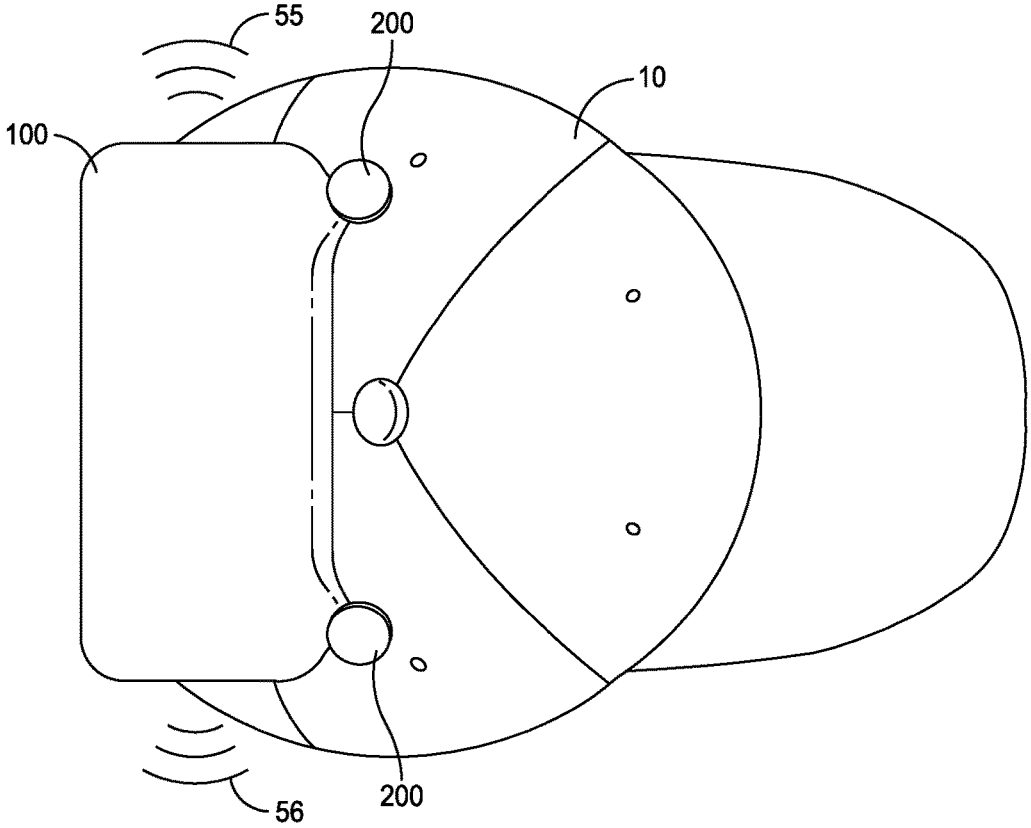
FIG. 2: is a top plan view of the pouch, button pins, phone and cap of FIG. 1.
Figure 3:
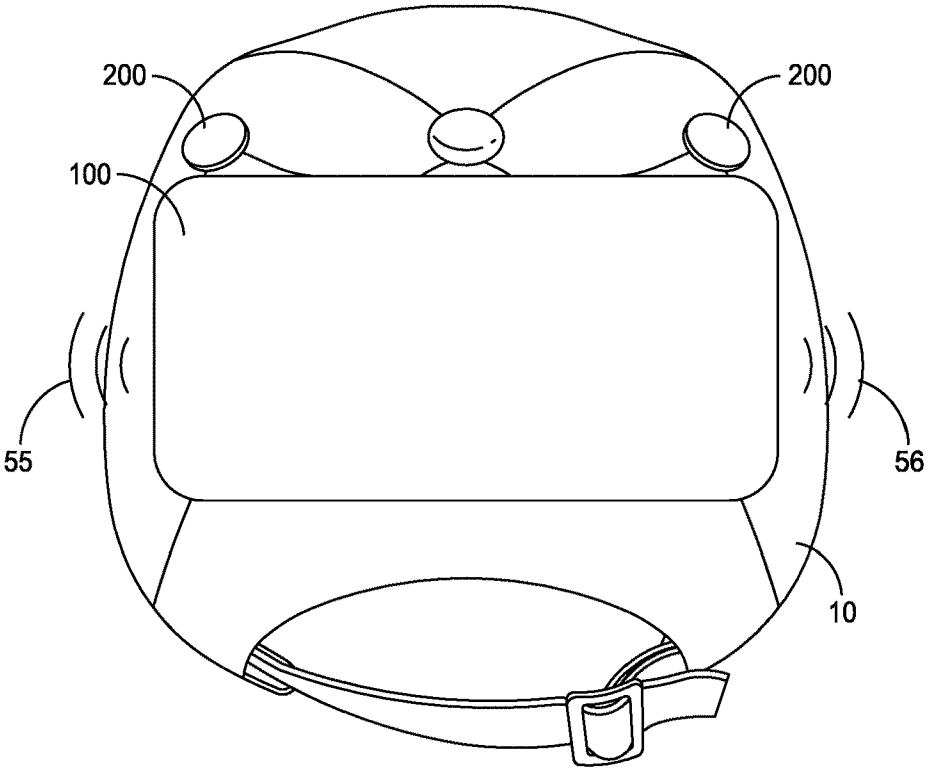
FIG. 3: is a rear perspective view of the pouch, button pins, phone and cap of FIG. 1.

As shown in FIGS. 1-3, the mobile phone 50 in the pouch 100 is shown on the rear of the cap 10, positioned so that the mobile phone internal speakers (top and bottom internal speakers, as one would use the phone to make telephone calls) are positioned to distribute audio to the left and right ears of the wearer, so that the left ear is closer to the left speaker and the right ear is closer to the right speaker. (the terms "left" and "right" are arbitrary as they concern the mobile phone 50, since the phone can be inserted into the pouch 100 in different orientations. It is preferred that the phone is positioned substantially horizontally along the front or back of the hat, so that the "ear facing internal speaker", as when making phone calls, faces forward and downward toward the ears; and the "mouth facing internal speaker" faces laterally outwardly, as in, for example, if an iPhone 8 was used as the mobile phone 50). (Alternatively, the pouch can be fastened to a shirt, dress, jacket or other upper body covering, so that the left and right internal speakers are positioned to direct sound to the left and right ears respectively). This allows for a left audio channel 55 to be mostly delivered to the left ear and a right audio channel 56 to be mostly delivered to the right ear of the wearer of the cap 10. While both mono and stereo settings can be used on the mobile phone 50, the stereo setting provides the most interesting audio quality, since the positioning of the speakers (downward and toward the ears) allows for the two stereo channels to be distinguished easily by the wearer, much like the two channels of headphones can be distinguished. However, the inconvenience of currently popular headphone and ear bud devices which rely on wires or blue tooth charging are eliminated.

Figure 4A:
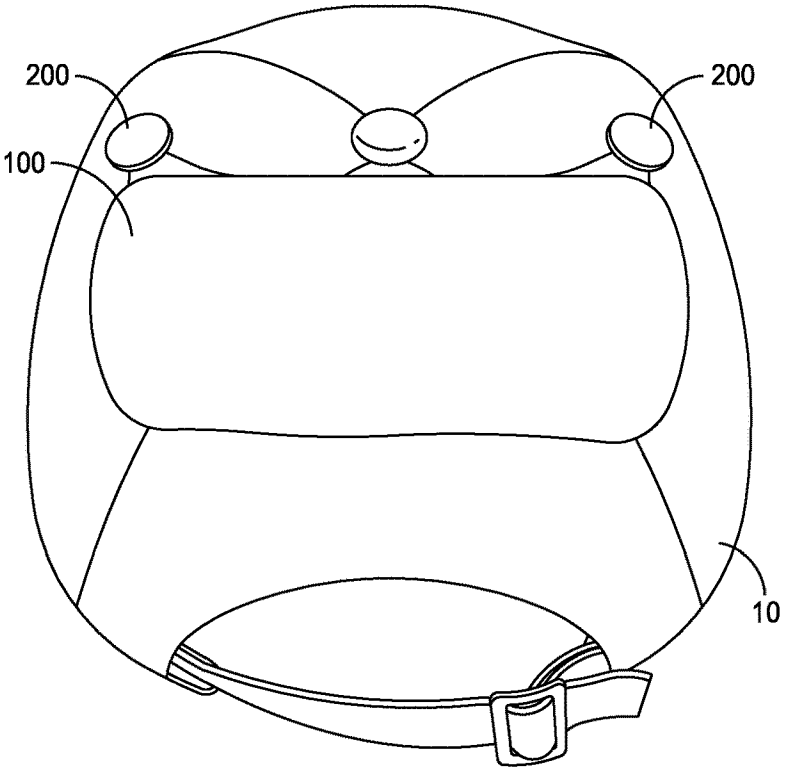
FIG. 4*a*: is a rear perspective of the pouch, button pins, and cap without the phone.
Figure 4C:
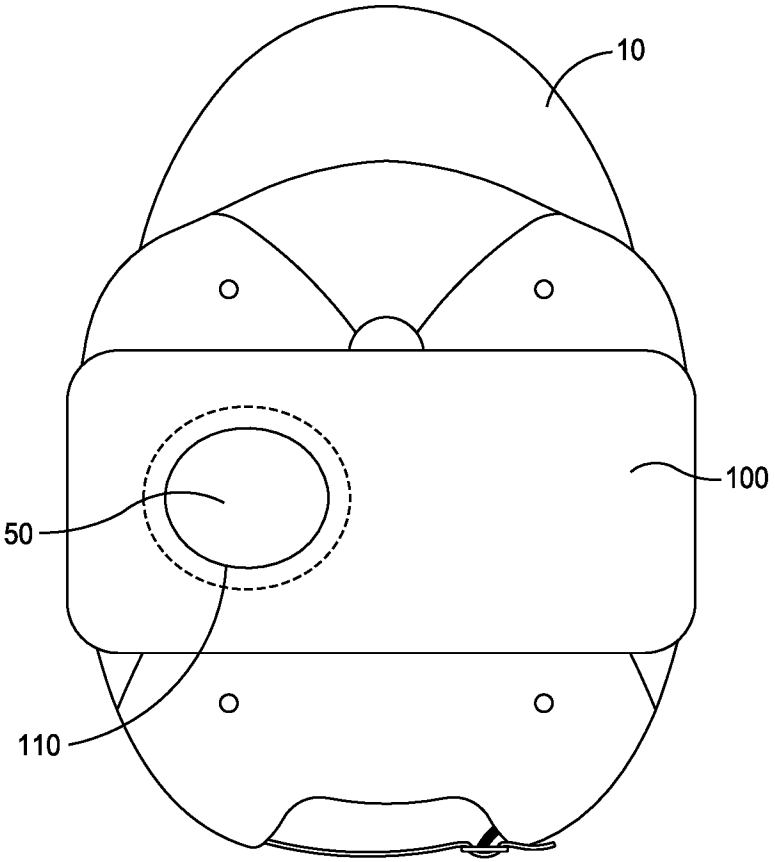
FIG. 4*c*: is a rear perspective of the pouch showing the phone fully inserted into the pouch before it is flipped over.
Figure 4B:
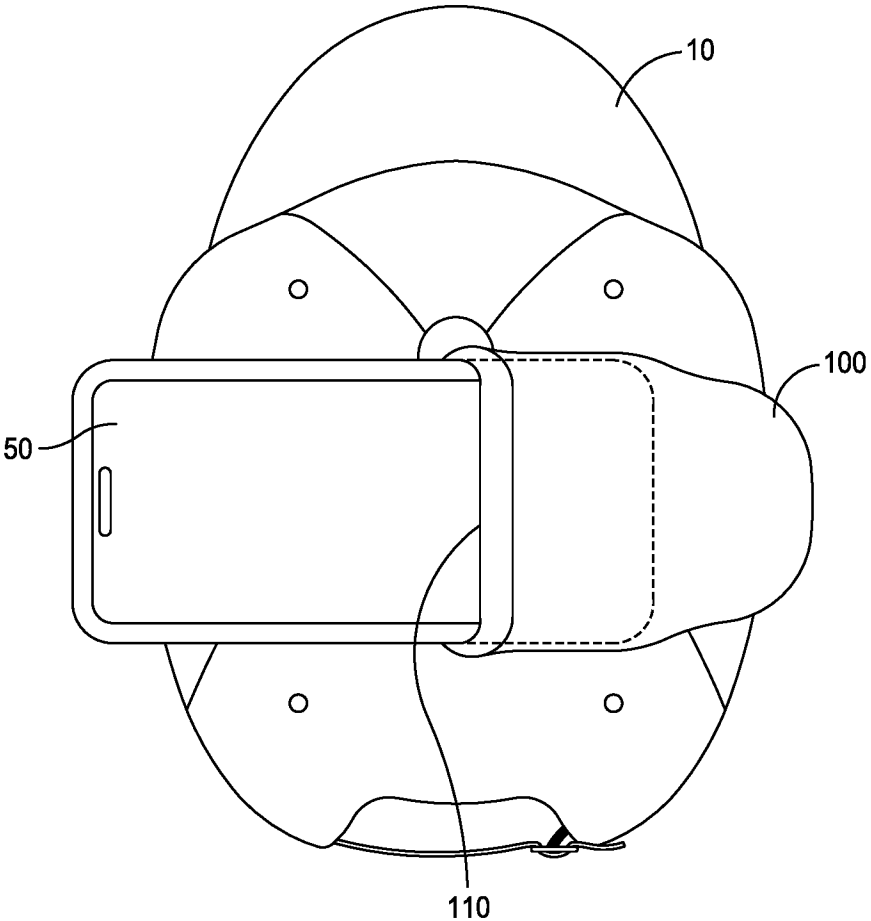
FIG. 4*b*: is a rear perspective of the pouch showing how the phone can be inserted into the pouch.
Figure 5:
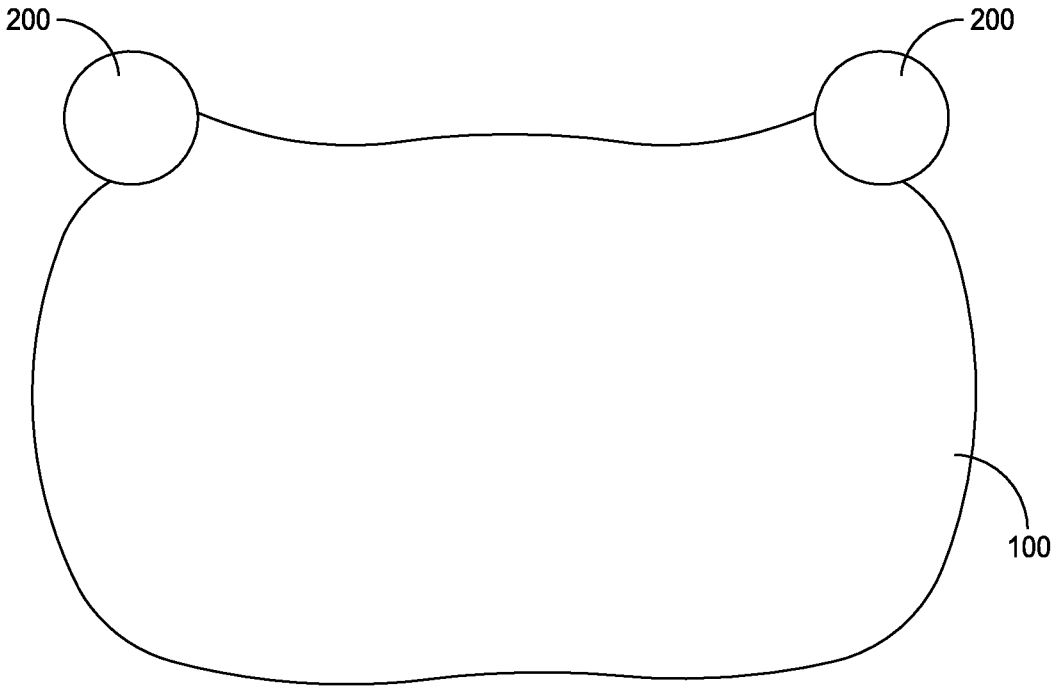
FIG. 5: is a top plan view of the phone pouch and button pins.
Figure 6:
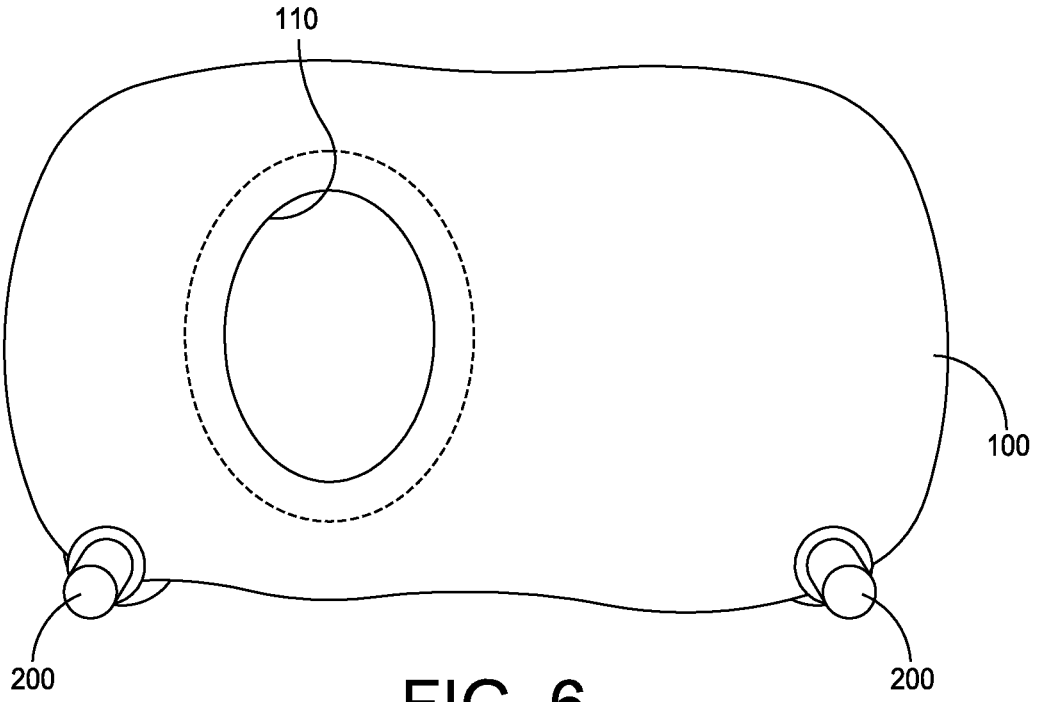
FIG. 6: is a bottom plan view of the phone pouch and button pins of FIG. 5, revealing an access opening for inserting a phone.
Figure 7:
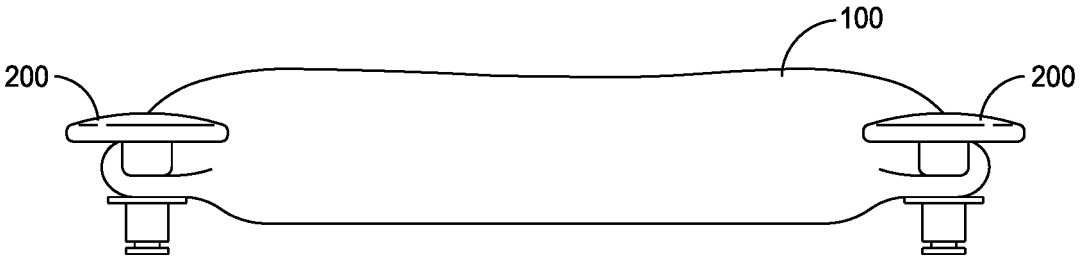
FIG. 7: is a front plan view of the phone pouch and button pins of FIG. 5.
Figure 8:
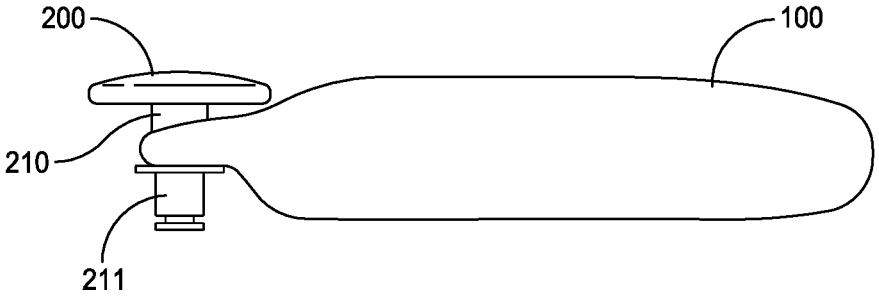
FIG. 8: is a left plan view of the phone pouch and button pins of FIG. 5.
Figure 9:
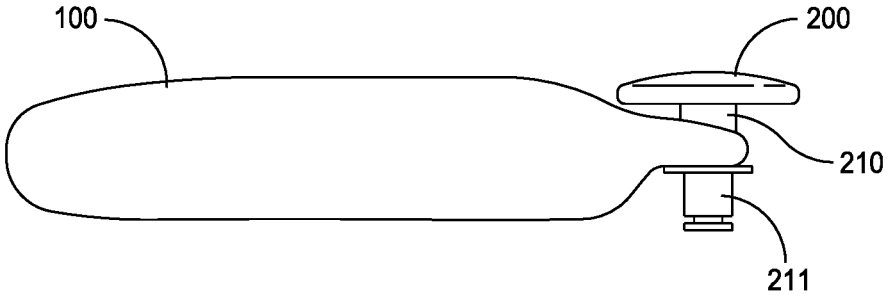
FIG. 9: is a right plan view of the phone pouch and button pins of FIG. 5.
Figure 10:
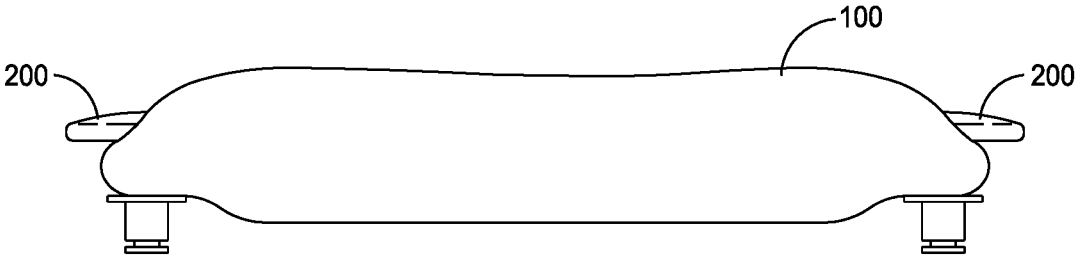
FIG. 10: is a rear plan view of the phone pouch and button pins of FIG. 5.

FIGS. 4*a*-4*c* show how easily the mobile phone 50 can be inserted into the preferred pouch 50. As shown in FIG. 4*a*, the pouch 100 is first fastened to the back of the cap 50, with its opening 110 facing down, by piercing the pointed ends of the button pin caps 210 through both the cap 50 and pouch 100 material, and clasping the rivet pins 211 onto of the exposed pointed ends of the caps 210 (one to four button pin fasteners 200 can be used for this purpose). Two caps 210 are shown exposed in FIG. 4*a* while the two matching rivet pins 211 are hidden inside the cap 10, but even these positions could be reversed. Once the pouch 100 is thus secured, it can be flipped up to reveal its bottom view and opening 110. The preferred opening 110 is shown as an oval or round opening with a seamed edge, although it can be a slotted or other shape. As shown in FIG. 4*b*, the mobile phone 50 is inserted longitudinally, substantially horizontally to the cap as it would sit on a head, into the opening 110, so that its ear facing speaker faces up away from the hat, at least initially. As shown in FIG. 4*c*, the phone 50 and pouch 100 are then flipped back down, so that the ear facing speaker faces toward the ear (the orientation can be reversed without sacrificing phone safety, whereby the opening 110 can be facing up away from the hat during use, and the ear facing speaker can be disposed facing downwardly and forwardly so that it faces the wearer's ear. In this orientation, the back of the phone can be seen in the opening 110, while the cap 10 is worn. Likewise, but less desirably, the ear facing internal speaker can be positioned facing upwardly and rearwardly, away from the ear, and still provide two separate channels to the wearer.

As shown in FIG. 5-10, a preferred embodiment for the mobile phone pouch 100 is described. The pouch 100 is preferably made from an elastic fabric capable of stretching at least about 10-50% and up to about 100-150%. Elastic fabrics a desirable, so that the pouch 100 can be made smaller than phone 50, but expand to receive the entire phone 50 (and case optionally), and once inserted, can be snapped over the phone 50 to secure it snuggly in place. The elastic nature of the fabric allows the corners and sides of the phone 50 to be tightly gripped, so that the phone 50 can be released by again stretching the elastic fabric of the pouch 100 to release the phone from the pouch 100 through the opening 110. After the phone is removed, the pouch released of tension, should return substantially to its original size and shape. The elastic fabric can be washable and should be readily pierced by the button pin fasteners 200. Simple elastic fabrics can include cotton-elastane (Spandex) blends, which have 80-99% cotton and 1-20% elastane fiber. Part or all of the cotton can be substituted by synthetic fibers.

The pouch can also be made waterproof by using closed cell foam (neoprene), waterproof zippers, zip lock fasteners, and/or liquid water impermeable layers that preferably allow sound waves to pass (air breathable), such as TPU film, GoreTex (stretched PTFE film), or non-waterproof fabrics treated with fluorocarbon compositions (SCOTCHGARD water shield) to make them water resistant.

Fabric Selections:

Stretch fabrics are either 2-way stretch or 4-way stretch. 2-way stretch fabrics stretch in one direction, usually from selvedge to selvedge (but can be in other directions depending on the knit). 4-way stretch fabrics, such as spandex, stretches in both directions, crosswise and lengthwise. Stretchy materials refers to fabrics which can stretch without breaking the fibers and return to its original length. This stretch of the fibers provides the preferred tapes and wraps of this invention made with them the much needed ease, drape, comfort and fitting. See https://sewguide.com/stretchy-fabric/, which is incorporated herein by reference.

Knits:

Most of the knit fabrics have some stretch. Usually, it is a 2-way stretch, with less stretch in the weft direction. The stretch of a knit fabric makes it one of the most suitable fabric for tape and wraps. Jersey is a light to medium weight knit fabric with good stretch. Other suitable knit fabrics are: 3×3 Rib Knit, Bamboo Jersey, Doubleknit Rayon Blend, Interlock twist jersey, Double knit, Sweater Knit, Silk Mesh Knits and Silk Jersey.

Spandex:

Also suitable for this invention are Spandex fabrics, which is a generic name for stretchy fabrics with elastic content—the base could be cotton, nylon or wool and Lycra, a spandex fabric which is trademarked by Dupont Company. Its ability to stretch to almost 300-400 percentage on its own. The stretchiness of Spandex depends on its elastane content; 1-5% is desirable, whereas for sportswear an elastane content of about 12-15% is more preferred Spandex blends.

Spandex Blends:

When blended with other fibers spandex can lend about 2-20% of its elasticity to the new fibers.

- Cotton—spandex blend—Very smooth fabric with a 4 way stretch. The percentage of spandex usually is 3-5%. It can be used to make tape and wraps.
- Polyester—spandex Blend—This is very lightweight stretchy material with stretch;
- Stretch satin—This is a polyester-spandex blend in a satin finish;

Stretch velvet—This fabric with a napped surface can have about 15% stretch; and Polyester spandex fabric with or without foam backing.

The elastic fabrics of this invention used to make the pouch 100 should be substantially "acoustically permeable", capable of permitting sound to penetrate through the fabric. Sound travels through the air, so the fabric should be breathable to air, if sound is to make it through the fabric. If one can breathe through or blow through the fabric, it is probably acoustically permeable enough for this invention. Elastic fabrics can be chosen that have an open weave or knit and are breathable. Natural fibers such as cotton, linen, bamboo, and wool, alone or blended with spandex, rubber, or synthetic rubber, or fabrics made from rayon, nylon, polyester and or acrylic. The elastic fabric useful for this invention should have stretch memory (can be returned to their roughly their original tensity when stretched over a large phone or exposed to humidity). Lucia and Cara fabrics from Camira, commonly used for office seating, or cotton, cotton and polyester, bamboo, polyester and spandex or their blends commonly used for socks, would also be desirable. Cotton and polyester blended fiber sock fabrics are durable, water-resistant, and soft (so they won't scratch the phone screen). Bamboo fabric is also a good choice, since it breathable, stretchable, elastic, soft, lightweight, and hypo-allergenic and antimicrobial.

The pouches 100 of this invention are preferably removably or permanently fastened to an article of clothing, such as a hat, blouse, shirt or jacket. Adhesive, rivets, stud buttons, or sewn threads could be used to fix the pouch to clothing, but it may be more desirable to use releasable fasteners, safety pins, threaded rivets, or button pins, which allow for separation of the pouch from clothing for cleaning and the like. One useful option are jean button pins, often used for jeans waist tightening. They come as sets of button pin cap 210 and rivet pin 211, shown in FIGS. 5-8. Button cap sizes can vary from about 3-20 mm in diameter and about 10-20 mm deep, and rivet pins can be about 2-15 mm in diameter and about 5-15 mm deep. The buttons can be installed and removed quickly and should be rust-resistant. During use, the small flat flange on the back of the rivet pin 211 is pulled out before you can detach the cap 210 from the rivet pin 211. Since they are strong enough to hold the waist of jeans from coming undone, they appear to be able to hold the weight of most mobile phone without unsecuring, especially if two or more button pin fasteners 200 are used. Mobile phones are generally between 130 g and 200 g with the heaviest being about 300 g. www.quora.com/What-does-a-mobile-phone-weight.

EMF or RF Shielding Material:

The pouches of this invention can also contain an EMF or RF shielding material, often referred to as Faraday fabric. Electromagnetic and radio frequency radiation cannot pass through holes in conductive material which are smaller than their wavelength. In this fashion, it is possible to shield a wearer's head, body and particularly the brain from EMF or RF radiation from the mobile device in the pouch 100 with a conductive metal or graphite wire-mesh, impregnated yarn or weave, or sputtered type coating. When encountering this electromagnetic shield, radiation from the mobile phone 50 induces a displacement of electrons inside the conductive material, which causes, in return, the radiation to be reflected back inside the pouch 100 instead of into the head and brain of the wearer. While such protection will interfere with calls and internet access, it should not interfere with music previously saved in local storage on the mobile phone. It should be substantially acoustically transparent, or breathable, for this purpose.

A metallic layer, such as a silver or copper layer, on the pouch or woven with or coated onto the threads of the fabric, acts as a wire-mesh and shields what's outside the pouch from RF/EMF. The material used for copper compression socks may be useful as a RF/EMF block. Copper compression socks use infused copper, such as Cupron Antifungal fibers, or copper-based conductive yarn, which is woven in the fabric. Winter touch screen gloves also use this property to allow users to operate touch screens on their phones without taking off their gloves.

Other fabric choices could also include more specifically designed Faraday cages, mesh, fibers or fabric, EMF/EMI/RF fabric, etc. These shielding materials work because radiation in radio frequencies (RF) is blocked by graphite, graphene, and certain metals, such as: gold, silver, copper, aluminum, steel, stainless steel, but because of its RF wavelength, the metal doesn't even have to be solid—it can be a solid cage or flexible mesh, screen, film or woven or knitted fibers, or natural or synthetic fibers coated with metals, such as by sputtering. Many scientific facilities are lined with materials like this to prevent outside radiation from interfering with sensitive measurements. Available shielding fabrics are constructed of meshed nettings of multiple blended fibers with random mesh opening sizes. This design eliminates frequency-specific open slots, preventing peaks of EMI/RF leakage and results in an exceptionally flat shielding effectiveness profile across its specified frequency range. It also ensures a tight EMI/RF seal at seams, connections and terminations.

Another specific material useful for this purpose is called Amradield High Conductive Silver Fiber Fabric, available from Amradield Professional Textiles Factory, 1158 Laodong Rd., Suzhou, 江, 215004, CN. Amradield fabric is a highly electrically conductive silver/nylon material which is very soft, stretchable and flexible. https://www.amazon.com/Grounding-Conductive-Electrode-Magnetic-Blocking/dp/B07V3VTBWV. Amradield fabric contains radiation EMF protective, silver conductive fibers that provide a shielding cage. This shielding electromagnetic fabric product is claimed to possess a surface resistance: below 0.1 ohm, average attenuation of 70 dB from 10 MHz-3 GHz, RF/EMI/EMF/LF blocking, super earthing/grounding, anti-static/radiation/radio wave/microwave properties. This technology is potentially capable of blocking up to 99% of microwaves, which includes wifi radiation, bluetooth, and cellphone radiation. It contains elastic nylon tri-cot fabric with vacuum sputtered silver coated thereon. The silver/nylon fibers/fabric is very soft and flexible. It is described as a stretchable fabric.

Another stretchable material suitable for the pouch fabric is LVFEIER anti jamming shielding electromagnetic wave radiation shielding cloth, available from Lvfeier Maternity, Shiyan DHKQ Manufacture and Trading Co., Ltd., China. This elastic material elastic, can be worn close to the body, and used for headscarves, underwear, hats, etc. High shielding (non-intermediate shielding) materials are used to shield radio frequency signals, such as 3G, 4G, 5G, WiFi, mobile phones, GPS, Bluetooth. Used for EMP protection, mobile phone signal shielding, EMI radiation reduction, radio meter shielding, effective shielding of microwave signals, telephones, intelligent instruments, security systems, radar, military broadcasting, etc. It can be used for making radiation-proof clothes, radiation-proof underwear, radiation-proof caps, radiation-proof shorts, radiation-proof headscarves, radiation-proof pajamas, radiation-proof bedsheets, radiation-proof pillowcases, radiation-proof sleeping bags, etc. Raw fiber materials include 80% high elasticity spandex, 20% silver.

Another such material, SM-10 RF Green® shielding fabrics are offered in nickel and copper plated polyester mesh netting to provide outstanding shielding effectiveness and surface conductivity. These fibers and/or fabrics accommodate complex contours and shapes, and could be used in the pouch.

Recently, companies like Silent Pocket have integrated meshes into bags and cases that totally isolate devices from incoming signals. Researchers at Drexel University have managed to create a Faraday fabric by infusing ordinary cotton with a compound called MXene.

RF radiation is not known to be harmful in the doses and frequencies we normally get exposed to in everyday life. The FCC makes sure no device exceeds certain thresholds. But there's also the possibility that one's phone or laptop is naively connecting to public Wi-Fi, getting its MAC number skimmed by other devices, and otherwise interacting with the environment in a way you might not like. And with the amount of devices emitting radiation right now, who wouldn't mind lowering their dose of RF radiation just a little.

From the foregoing, it can be realized that this invention provides improved mobile phone pouches for securely fastening mobile phones to clothing such as hats and shirts. The pouches of a first embodiment, provide for some acoustic transparency so that wearers can hear audio from their phone's internal speakers, preferably in stereo. Although various embodiments have been illustrated, this is for the purpose of describing, but not limiting the invention. Various modifications which will become apparent to one skilled in the art, are within the scope of this invention described in the attached claims.

I claim:

1. A soft mobile phone pouch and headwear combination, comprising:

a soft mobile pouch comprising: an elastic fabric tubular container having a longitudinal length, a width and a depth, said container having an inside surface defining an inside containment area and exterior surface, said elastic fabric being acoustically permeable;

an opening through a wall of said container to provide access to said inside containment area, said opening having a first cross-sectional dimension;

said opening stretchable to a second cross-sectional dimension to receive a mobile phone which has a first cross-sectional dimension larger than the first cross-sectional dimension of said opening, said mobile phone having at least first and second internal speakers;

at least one fastener for releasably attaching said pouch to said headwear in a horizontal position relative to a wearer of said headwear when said wearer is standing, so as to provide first sound waves from a first audio channel from said first internal speaker to be mostly delivered through said elastic fabric to a first of said wearer's ears, and to provide second sound waves from a second audio channel from said second internal speaker to be mostly delivered through said elastic fabric to a second of said wearer's ears, when said mobile phone is inserted into the pouch and said first and second internal speakers are acoustically activated.

2. The soft mobile phone pouch and headwear combination of claim 1, whereby said first internal speaker comprises a top internal speaker and said second internal speaker comprises a bottom internal speaker, as when said mobile phone is used to make a telephone call.

3. The soft mobile phone pouch and headwear combination of claim 1, whereby said first and second internal speakers provide mono or stereo settings.

4. The soft mobile phone pouch and headwear combination of claim 1, whereby said opening is protected by a sewn hem having elastic properties.

5. The soft mobile phone pouch and headwear combination of claim 1, wherein said elastic fabric comprises spandex fibers.

6. The soft mobile phone pouch and headwear combination of claim 1, wherein said fabric comprises a radio frequency absorber material or electromagnetic shielding material, or both, which does not mechanically interfere with said pouch when said pouch is permitted to reversibly stretch.

7. The soft mobile phone pouch and headwear combination of claim 1, wherein said fabric comprises graphite, graphene, aluminum, gold, steel, stainless steel, copper or silver.

8. In combination, an article of headwear having reversibly affixed thereto, a mobile phone pouch, wherein said mobile phone pouch comprises: a tubular container comprising an elastic, acoustically permeable, fabric, said tubular container having a longitudinal length, a width and a depth, said container having an inside surface defining an inside containment area and exterior surface; and an opening through a wall of said container to provide access to said inside containment area, said opening having a first cross-sectional dimension; and said opening stretchable to a second cross-sectional dimension to receive a mobile phone which has a first cross-sectional dimension larger than the first cross-sectional dimension of said opening;

said mobile phone having at least first and second internal speakers having at least first and second audio channels;

wherein said combination further comprises: at least one releasable fastener selected from the group consisting of: safety pins, threaded rivets and button pins, for releasably attaching said pouch to said headwear, whereby said mobile phone is positioned horizontally along the headgear so that first sound waves from said first audio channel for said first internal speaker are mostly delivered through said elastic, acoustically permeable, fabric to a first of said wearer's ears, while second sound waves from said second audio channel for said second internal speaker are mostly delivered through said elastic, acoustically permeable, fabric to a second of said wearer's ears.

9. The combination of claim 8, wherein said at least said first and second audio channels comprise two different stereo channels directed to the first and second ears of the wearer respectively.

10. The combination of claim 8, wherein said pouch is water resistant and comprises a water resistant closure mechanism.

11. A method of delivering sound from internal speakers of a mobile phone to the ears of a wearer of headgear, comprising:

(a) providing a soft mobile pouch comprising: a tubular container comprising an elastic, acoustically permeable fabric, said tubular container having a longitudinal length, a width and a depth, said container having an inside surface defining an inside containment area and an exterior surface; an opening through a wall of said container to provide access to said inside containment area, said opening having a first cross-sectional dimension; said opening stretchable to a second cross-sectional dimension;

(b) providing at least one fastener;

(c) providing a mobile phone which has a first cross-sectional dimension larger than the first cross-sectional dimension of said opening and which has at least first and second internal speakers;

(d) inserting said mobile phone into said inside containment area, while stretching said opening beyond its first cross-sectional dimension;

(e) releasably attaching said pouch with at least one fastener to said headwear, so that said pouch is in a horizontal position, so as to provide first sound waves from a first audio channel from said first internal speaker to be mostly delivered through said elastic, acoustically permeable fabric to a first of said wearer's ears, and to provide second sound waves from a second audio channel from said second internal speaker to be mostly delivered through said elastic, acoustically permeable fabric to a second of said wearer's ears, when said mobile phone is inserted into the pouch and said first and second internal speakers are acoustically activated.

12. The method of claim 11, wherein said providing a mobile phone step (c) comprises providing a mobile phone having said first internal speaker being a ear facing speaker, as when one is making a phone call, and said second internal speaker being a mouth facing internal speaker, as when one is making a phone call.

13. The method of claim 12, wherein said providing a mobile phone step (c) comprises positioning said ear facing speaker downward and toward the first ear of the wearer and positioning the mouth facing speaker laterally outwardly.

* * * * *